US009144747B2

(12) United States Patent
Pfiester

(10) Patent No.: US 9,144,747 B2
(45) Date of Patent: Sep. 29, 2015

(54) CONSTRUCTIBLE PLAYHOUSE

(71) Applicant: Betty J Pfiester, Burton, OH (US)

(72) Inventor: Betty J Pfiester, Burton, OH (US)

(73) Assignee: Bee's Creation, Burton, OH (US)

( * ) Notice: Subject to any disclaimer, the term of this patent is extended or adjusted under 35 U.S.C. 154(b) by 99 days.

(21) Appl. No.: 13/972,469

(22) Filed: Aug. 21, 2013

(65) Prior Publication Data

US 2015/0056888 A1 Feb. 26, 2015

(51) Int. Cl.
*A63H 3/52* (2006.01)

(52) U.S. Cl.
CPC ..... *A63H 3/52* (2013.01)

(58) Field of Classification Search
CPC ..... A63H 3/52; A63H 33/044; A63H 33/008; A63H 33/084; A63H 33/105
USPC ..... 446/476, 478; 273/241
See application file for complete search history.

(56) References Cited

U.S. PATENT DOCUMENTS

| | | | | | |
|---|---|---|---|---|---|
| 1,981,646 | A * | 11/1934 | Hamley | 434/211 |
| 2,241,169 | A * | 5/1941 | Yokes | 52/223.7 |
| 3,767,201 | A * | 10/1973 | Harper et al. | 273/241 |
| 3,996,693 | A * | 12/1976 | Walmer | 446/105 |
| 5,169,153 | A * | 12/1992 | Levy et al. | 273/241 |
| 5,482,490 | A * | 1/1996 | Weldon-Ming | 446/75 |
| 5,498,188 | A | 3/1996 | Deahr | |
| 5,647,181 | A * | 7/1997 | Hunts | 52/282.1 |
| 2002/0193046 | A1* | 12/2002 | Zebersky | 446/476 |
| 2003/0049992 | A1 | 3/2003 | Leemon | |
| 2008/0009218 | A1 | 1/2008 | Balanchi | |
| 2010/0093257 | A1* | 4/2010 | Elliott | 446/478 |

* cited by examiner

*Primary Examiner* — Vishu Mendiratta
(74) *Attorney, Agent, or Firm* — Tucker Ellis LLP

(57) ABSTRACT

A constructible playhouse may include interchangeable floors, ceilings, posts, and walls. The floors and ceilings may be a plurality of identical plates that may be connected together or stacked in a variety of ways using the posts. The plates may further include channel grooves in which additional accessories and add-ons may connect. The present invention may be easily assembled and disassembled for easy storage and portability.

20 Claims, 4 Drawing Sheets

CONSTRUCTIBLE PLAYHOUSE

BACKGROUND OF THE INVENTION

The present invention relates to a constructible playhouse and, more particularly, to a playhouse that may be easily constructed and accessorized.

A dollhouse or doll's house is a toy home, made in miniature. For the last century, dollhouses have primarily been the domain of children but their collection and crafting is also a hobby for many adults. Currently, dollhouses have a preset layout, limiting the creativity of the user. Further, the dollhouses cannot be disassembled and are therefore difficult to store. Dollhouses are primarily for girls and are normally disposed of or not used once the girl matures.

As can be seen, there is a need for a gender neutral playhouse that may be easily constructed and accessorized.

SUMMARY OF THE INVENTION

In one aspect of the present invention, a constructible playhouse comprises: a plurality of plates, comprising at least a first plate and a second plate each having a top surface, a bottom surface and an edge, wherein the first plate comprises at least one coupling on the top surface, wherein the second plate comprises at least one coupling on the bottom surface aligning with the at least one coupling of the first plate; and at least one post having a top end and a bottom end, wherein the bottom end is formed to connect with the at least one coupling of the first plate and the top end is formed to connect with the at least one coupling of the second plate.

In another aspect of the present invention, a constructible playhouse comprises: a plurality of plates each comprising a top surface, a bottom surface, and an edge, wherein the top surface comprises a first plurality of couplings and the bottom surface comprises a second plurality of couplings aligning with the first plurality of couplings; and a plurality of posts each having a top end and a bottom end, wherein the bottom end is formed to connect with the first plurality of couplings, and the top end is formed to connect with the second plurality of couplings, wherein when the plurality of posts are attached to the first and second plurality of couplings, the plurality of plates are connected and thereby stack above and below one another.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a constructible playhouse that may include interchangeable floors, ceilings, posts, and walls. In certain embodiments, the floors and ceilings may be made of plates that may be assembled and connected or stacked in a variety of ways using the posts. The present invention may be easily assembled and disassembled for easy storage and portability. The plates may further include channel grooves in which additional accessories and add-ons may connect. Various combinations of post lengths allow the distance between the floors and ceilings to be adjusted for different sized action figures and dolls.

The present invention may provide a creative method for children to play and build a doll or action figure house that may be easily disassembled and reassembled and does not take up a lot of space. The house may be easily connected together and stacked in a corner or small area so that the child may play alone or with other children.

Referring to FIGS. 1 through 8, the present invention may include a constructible playhouse. The constructible playhouse may include a plurality of plates 10. The plates 10 may form the floors and ceilings of the playhouse. The plates 10 may include a top surface, a bottom surface, and an edge along the parameter. In certain embodiments, the plates 10 may include a first plate and a second plate. The first plate may include at least one coupling 12 on the top surface, while the second plate may include at least one coupling 12 on the bottom surface.

Figure 7:
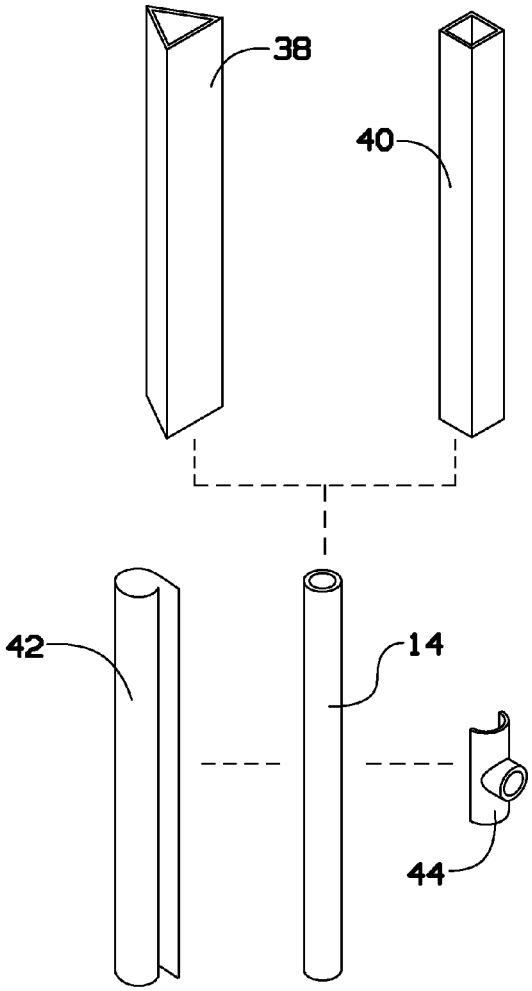
FIG. 7 is a perspective view of exemplary accessories.
Figure 8:
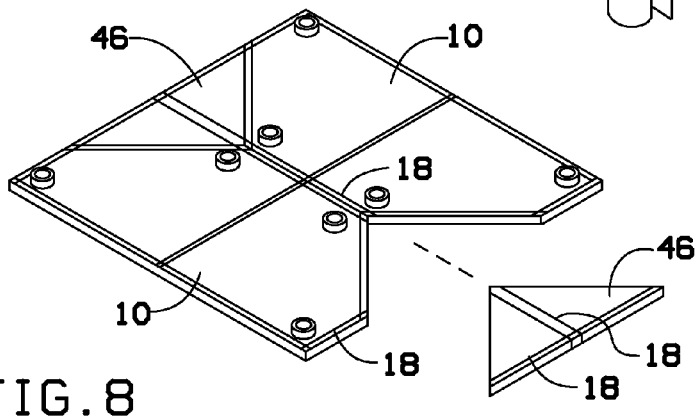
FIG. 8 is a perspective view of exemplary accessories.

In certain embodiments, the couplings 12 may align and the plates 10 may be attached together by at least one post 14. The at least one post 14 may include a top end and a bottom end. The top end may fit in the coupling 12 of the second plate, while the bottom end may fit in the coupling 12 of the first plate, thereby connecting the two plates and creating a floor out of the first plate and a ceiling out of the second plate. The posts 14 may be round in shape, similar to columns. However, as illustrated in FIG. 7, the posts may be triangular shaped 38, square shaped 40, or the like. Further, the columns may be customized with wall paper 42 for decoration, and post clips 44 that may secure additional accessories, such as a flag or sign.

Figure 3:
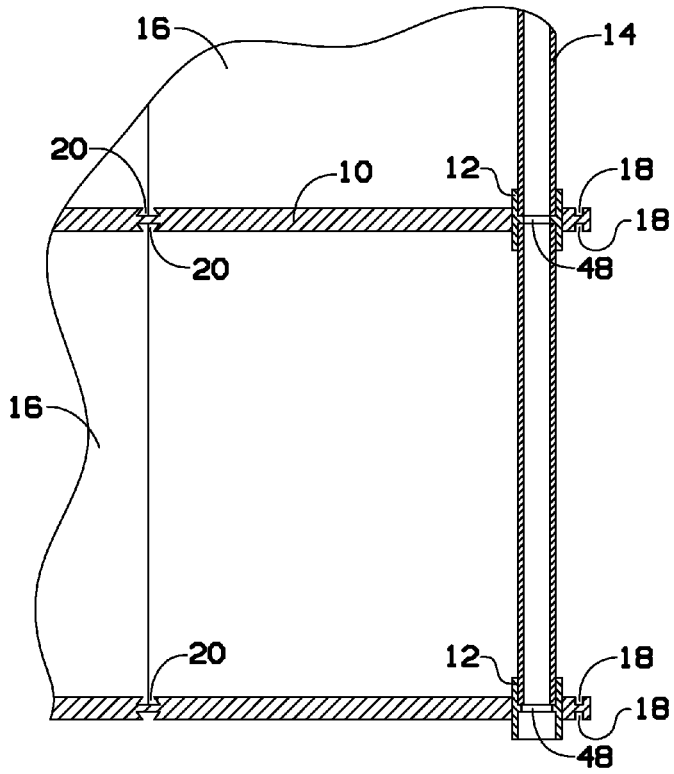
FIG. 3 is a section view of the present invention, taken along line 3-3 in FIG. 1.
Figure 4:
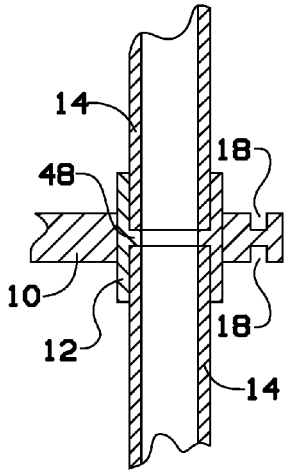
FIG. 4 is a detail section view of the present invention.
Figure 5:
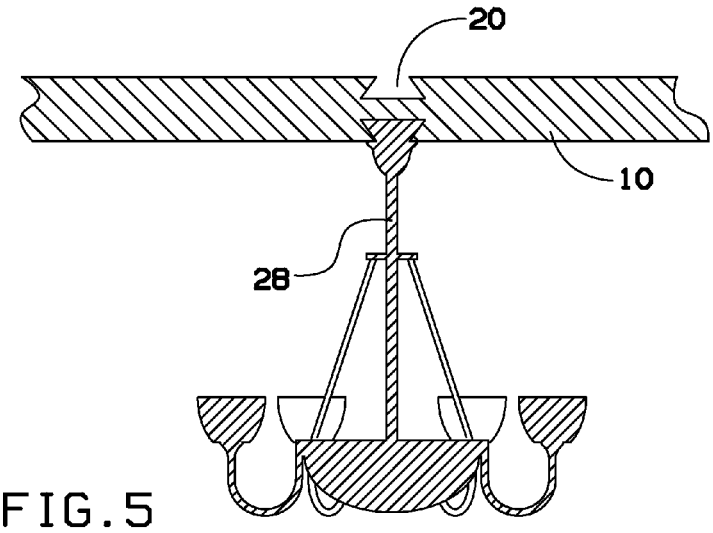
FIG. 5 is a detail section view of the present invention.

The plates 10 of the present invention may be made of a substantially rigid material, such as plastic, wood, and the like. In certain embodiments, each plate 10 may be substantially the same. Therefore, each plate 10 may include couplings 14 on the top surface and the bottom surface and may include the same shape. As illustrated in FIG. 3, the top surfaces and bottom surfaces may mirror each other, and the couplings 12 of the top surface and bottom surface may align. A coupling stop 48 may be in between the couplings 12 of the same plate 10 and thereby prevent the posts from running through. Since the plates 10 may mirror one another, the plates 10 may be continually stacked using the posts 14. As illustrated in the Figures, the plates 10 may be a polygon shape with straight edges. However, the present invention is not limited to a polygon shape and may be any shaped desired to construct a playhouse.

Figure 6:
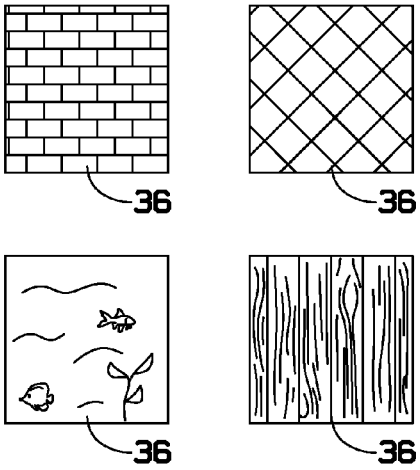
FIG. 6 is a front view of exemplary accessories.

In certain embodiments, the plates 10 may further include grooves 18 along the straight edges. The grooves 18 may be along the parameter of the top surface and/or bottom surface. The ends of the grooves 18 may overlap each other and may come to an end at an adjacent edge. Therefore, as illustrated in the Figures, the edges may have a similar shape to that of an I-beam. The present invention may further include walls 16 that may fit within the grooves 18. The walls 16 may include a top edge and a bottom edge. The top edge may fit within a groove 18 on a bottom surface of a plate 10, and the bottom edge may fit within a groove 18 of a top surface of a plate 10, and may thereby be secured in between the plates, creating an enclosure in the playhouse. As illustrated in FIG. 6, the walls 14 may include different types of wallpaper/graphics 36.

Figure 1:
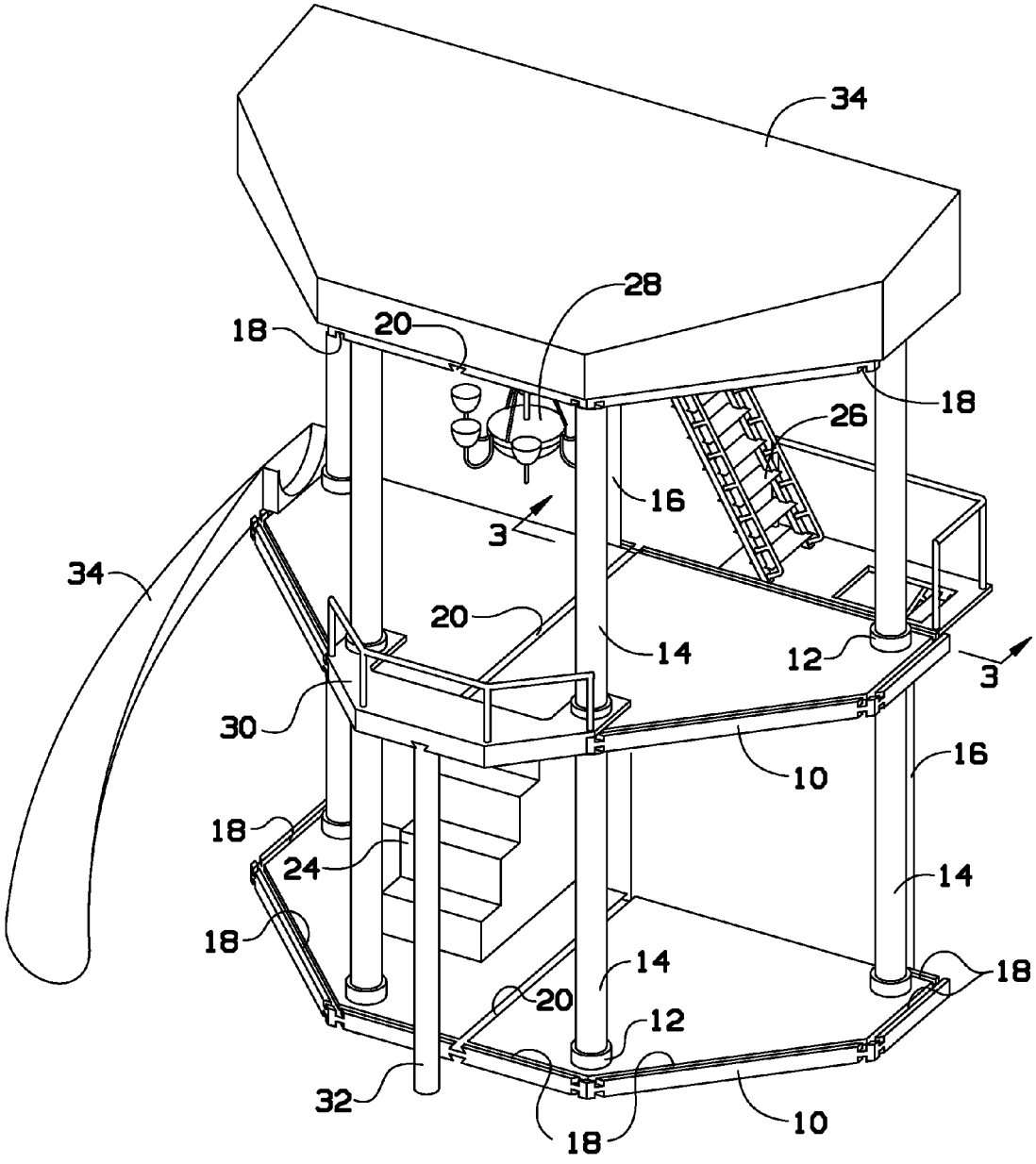
FIG. 1 is a perspective view of the present invention, shown with optional accessories.
Figure 2:
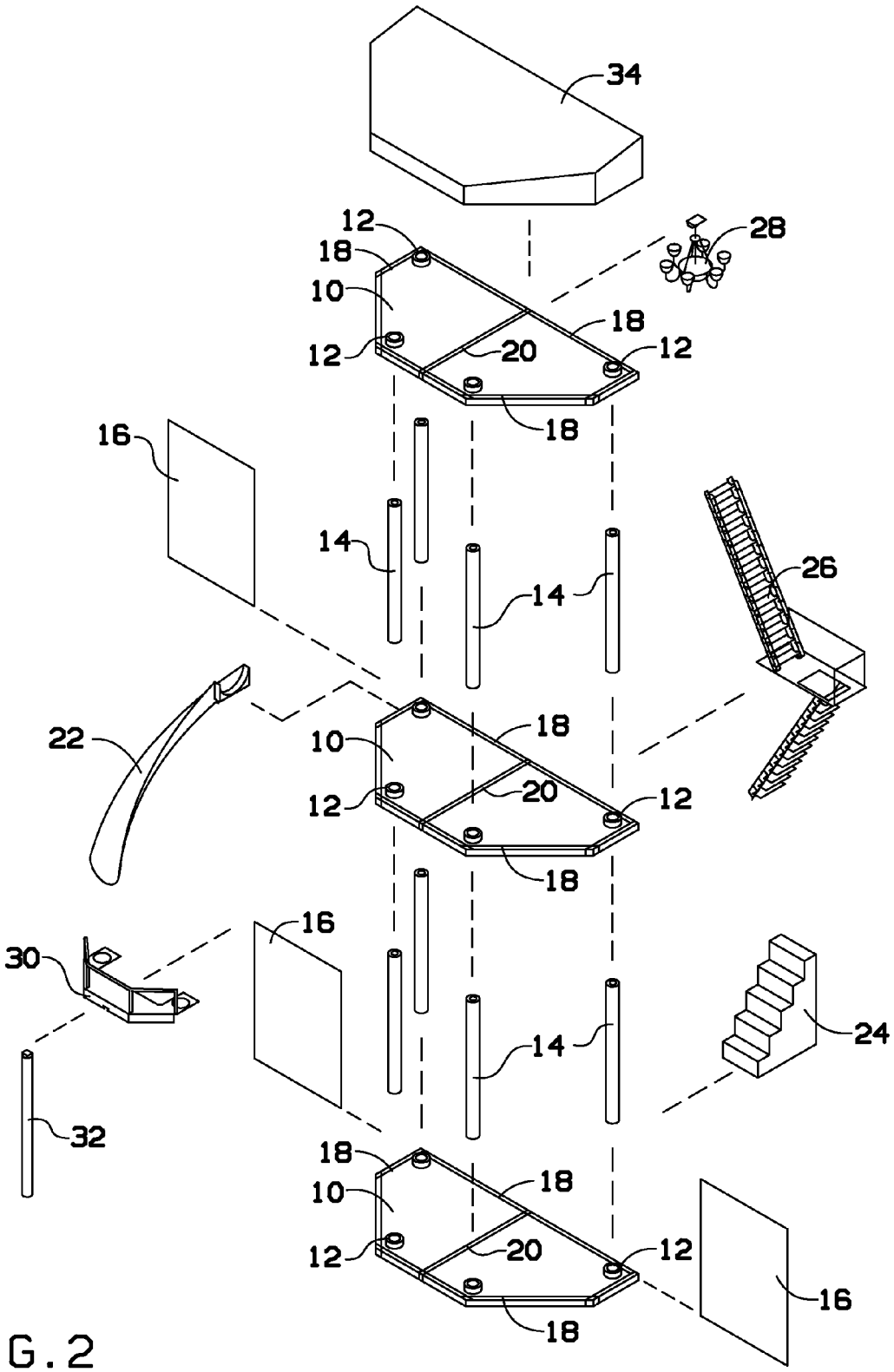
FIG. 2 is an exploded view of the present invention, shown with optional accessories.

In certain embodiments, the present invention may include multiple add-ons that may attach to the playhouse. Certain add-ons may be secured to the grooves 18 around the parameter of the plates 10. As illustrated in FIG. 1, a slide 22, a fire escape 26, and a balcony 30 may be secured by the groove 18. In certain embodiments, the balcony 30 may include openings that may fit around the posts 12 and/or the couplings 12. Therefore, the balcony 30 may be placed onto the coupling 12 prior to the coupling of the post 12 and may be further secured to the playhouse. The present invention may further include a balcony post 32 to further support the balcony 30.

In certain embodiments, different add-ons may be placed within the enclosure of the playhouse. For example, miniature furniture, dolls, and figurines, may be placed within the playhouse; as well as magnetic enhancements added to the walls. In certain embodiments, stairs 24 may be placed within the enclosure as well. Additional grooves, such as dovetail grooves 20 may extend from the outside edges of the plates towards the middle, and run across the plate to the opposite edge. Therefore, additional walls 16 may be placed within the grooves 20 to divide the playhouse into separate rooms. Further, additional decorative components may be added, such as chandeliers 28, ceiling fans, and the like.

Additional structural components may be added as well. A roof 34 may be used to cover the top plate 10. The roof 34 may be placed on the top of the top plate 10 once the multiple floors of the playhouse have been constructed. Additionally, connector pieces 46 may be used to connect multiple plates horizontally. This may allow users to create wider buildings as opposed to limiting the construction to taller buildings. The present invention may be used as a play house, building, or structure. When the child has outgrown the product he/she can use it as a bookshelf or storage unit. The present invention may allow the child to use creativity in building his/hers structure.

The present invention may be made of wood, PVC pipe and/or molded plastics. The floor plates may be shaped in a variety of geometric shapes, such as a modified hexagon, triangle, and square. The modified hexagon may fit snugly in a corner. A groove may be formed along the outside edge and down the center of the floor/ceiling plate. The couplings or openings may accommodate the posts and firmly join the floor plate to the ceiling plate. The optional walls may be made from a variety of products, such as but not limited to, press wood, cardboard, acrylic, Plexiglas®, white board, magnetic material and the like, and may be printed in various designs to allow a colorful change in the décor.

The present invention may be used by a girl or a boy in a broad age range. The primary pieces may be gender neutral and may be personalized to fit the child's creative ideas. The present invention may be decorated as a doll house or an action figure building. The walls may add another dimension to the design, such as changing the rooms to a restaurant, hair salon, mechanics garage, classroom, airport or the like. The present invention may also be put together or taken apart quickly or may be left together without taking up a lot of space. The present invention may allow the child to use his/her creativity for endless possibilities. Accessories may be available to personalize the space in colorful detail. Additionally, when the child has outgrown the play aspect of this product, it can still be used as shelving.

It should be understood, of course, that the foregoing relates to exemplary embodiments of the invention and that modifications may be made without departing from the spirit and scope of the invention as set forth in the following claims.

What is claimed is:

1. A constructible playhouse comprising:

a plurality of plates, comprising at least a first plate and a second plate each having a top surface, a bottom surface and an edge, wherein the first plate comprises at least one coupling on the top surface and the second plate comprises at least one coupling on the bottom surface aligning with the at least one coupling of the first plate, wherein the top surface of the first plate and the bottom surface of the second plate further comprise a plurality of grooves running along the edges, at least one of the grooves on each plate opening to an outside of the respective plate, and wherein the at least one coupling on the top surface of the first plate and the at least one coupling on the bottom surface of the second plate are inwardly spaced from the respective grooves;

at least one post having a top end and a bottom end, wherein the bottom end is formed to connect with the at least one coupling of the first plate and the top end is formed to connect with the at least one coupling of the second plate, and walls comprising a top edge and a bottom edge, wherein the top edge and the bottom edge are formed to fit within the grooves.

2. The constructible playhouse of claim 1, wherein the plates are a polygon shape with straight edge.

3. The constructible playhouse of claim 1, wherein the top surface of the first plate and the bottom surface of the second plate further comprise a groove running through the center of the plates from the first edge to a second edge.

4. The contractible playhouse of claim 3, further comprising add-ons formed to attach to the groove.

5. A reconfigurable playhouse comprising:

a first plate having a top surface, a bottom surface, an edge, a plurality of grooves along the edge opening to the top surface, and a plurality of couplings;

a second plate having a top surface, a bottom surface, an edge, a plurality of grooves along the edge opening to the top surface, a plurality of grooves along the edge opening to the bottom surface, and a plurality of couplings for connecting to posts extending above the second plate and posts extending below the second plate;

a plurality of posts having top and bottom ends, the top ends being configured to connect to the couplings of the second plate and the bottom ends being configured to connect to the couplings of the first plate; and a plurality of wall segments having top and bottom edges, the top edges configured to be received in the grooves opening to the bottom surface of the second plate and the bottom edges configured to be received in the grooves opening to the top surface of the first plate, wherein the couplings of the first plate are inwardly spaced from the grooves along the edge of the first plate, and the couplings of the second plate are inwardly spaced from the grooves along the edge of the second plate.

6. The reconfigurable playhouse of claim 5, wherein each coupling of the second plate includes a top portion for connecting to a post extending above the second plate and a bottom portion for connecting to a post extending below the second plate.

7. The reconfigurable playhouse of claim 6, where each coupling of the second plate includes a stop separating the top portion from the bottom portion.

8. The reconfigurable playhouse of claim 5, further including a first dovetail groove extending from one end to the second plate to another end.

9. The reconfigurable playhouse according to claim 8, further including a second dovetail groove extending from one end of the second plate to the other end, wherein the first dovetail groove opens to the top surface and the second dovetail groove opens to the bottom surface.

10. The reconfigurable playhouse of claim 5, further including at least one add-on that has an edge that is configured to be received in one of the grooves opening to the top surface of the first or second plate and at least one opening configured to surround one of the posts.

11. The reconfigurable playhouse of claim 5, wherein the posts are configured to connect to the couplings without fasteners.

12. The reconfigurable playhouse according to claim 5, wherein each coupling has an opening that receives the top or bottom end of one of the plurality of posts to connect the post to the coupling.

13. The reconfigurable playhouse of claim 5, further including a connector piece having a top surface, a bottom surface, an edge, and a groove along the edge opening to the top surface, wherein the connector piece is configured to abut the first plate such that the groove aligns with one of the grooves of the first plate.

14. The reconfigurable playhouse of claim 5, wherein a plurality of grooves of each plate open to an outside of the respective plate such that the wall segments are insertable axially into the grooves.

15. A reconfigurable playhouse comprising:

a first plate having a top surface, a bottom surface, an edge, a plurality of grooves along the edge opening to the top surface, and a plurality of couplings;

a second plate having a top surface, a bottom surface, an edge, a plurality of grooves along the edge opening to the top surface, a plurality of grooves along the edge opening to the bottom surface, and a plurality of couplings for connecting to posts extending above the second plate and posts extending below the second plate;

a plurality of posts having top and bottom ends, the top ends being configured to connect to the couplings of the second plate and the bottom ends being configured to connect to the couplings of the first plate;

a plurality of wall segments having top and bottom edges, the top edges configured to be received in the grooves opening to the bottom surface of the second plate and the bottom edges configured to be received in the grooves opening to the top surface of the first plate, and a first dovetail groove extending from one end to the second plate to another end.

16. The reconfigurable playhouse according to claim 15, further including a second dovetail groove extending from one end of the second plate to the other end, wherein the first dovetail groove opens to the top surface and the second dovetail groove opens to the bottom surface.

17. The reconfigurable playhouse of claim 15, wherein each coupling of the second plate includes a top portion for connecting to a post extending above the second plate and a bottom portion for connecting to a post extending below the second plate.

18. The reconfigurable playhouse of claim 17, where each coupling of the second plate includes a stop separating the top portion from the bottom portion.

19. The reconfigurable playhouse of claim 15, further including at least one add-on that has an edge that is configured to be received in one of the grooves opening to the top surface of the first or second plate and at least one opening configured to surround one of the posts.

20. The reconfigurable playhouse according to claim 15, wherein each coupling has an opening that receives the top or bottom end of one of the plurality of posts to connect the post to the coupling.

* * * * *